US010984639B2

(12) United States Patent
Soulhiard et al.

(10) Patent No.: US 10,984,639 B2
(45) Date of Patent: Apr. 20, 2021

(54) METHOD AND DEVICE FOR DOOR MONITORING AND DOOR MONITORING SYSTEM INCLUDING SUCH A DEVICE

(71) Applicant: INVOXIA, Issy les Moulineaux (FR)

(72) Inventors: Ludovine Soulhiard, Paris (FR); Serge Renouard, Rueil Malmaison (FR)

(73) Assignee: INVOXIA, Issy les Moulineaux (FR)

( * ) Notice: Subject to any disclaimer, the term of this patent is extended or adjusted under 35 U.S.C. 154(b) by 87 days.

(21) Appl. No.: 16/034,614

(22) Filed: Jul. 13, 2018

(65) Prior Publication Data

US 2019/0019381 A1 Jan. 17, 2019

(30) Foreign Application Priority Data

Jul. 13, 2017 (FR) ..... 17 56683

(51) Int. Cl.

| | |
|---|---|
| ***G08B 13/08*** | (2006.01) |
| ***G08B 13/00*** | (2006.01) |
| ***G07C 9/00*** | (2020.01) |
| ***E05F 15/48*** | (2015.01) |
| ***E05F 15/70*** | (2015.01) |
| ***G08B 13/19*** | (2006.01) |
| ***G08B 29/18*** | (2006.01) |

(52) U.S. Cl.

CPC ..... *G08B 13/08* (2013.01); *E05F 15/48* (2015.01); *E05F 15/70* (2015.01); *G07C 9/00174* (2013.01); *G07C 9/00571* (2013.01); *G08B 13/00* (2013.01); *G08B 13/19* (2013.01); *G08B 29/185* (2013.01); *E05Y 2400/44* (2013.01); *E05Y 2900/132* (2013.01); *G07C 9/00896* (2013.01); *G07C 2009/00769* (2013.01); *G07C 2209/62* (2013.01)

(58) Field of Classification Search

CPC ..... E05F 15/48; E05F 15/70; G08B 13/19; G08B 29/185; G08B 13/08; E05Y 2400/44; E05Y 2900/132

USPC ..... 340/540

See application file for complete search history.

(56) References Cited

U.S. PATENT DOCUMENTS

| | | | | |
|---|---|---|---|---|
| 2009/0261973 | A1* | 10/2009 | Eakle, Jr. | E05B 41/00 340/540 |
| 2011/0016971 | A1 | 1/2011 | Yulkowski et al. | |
| 2014/0292481 | A1* | 10/2014 | Dumas | G07C 9/00174 340/5.61 |
| 2015/0287298 | A1* | 10/2015 | Zur | G08B 13/08 340/545.2 |
| 2016/0027268 | A1* | 1/2016 | Lamb | G08B 29/185 340/545.1 |

(Continued)

OTHER PUBLICATIONS

French Search Report related to Application No. FR 1756683; search completed on Mar. 13, 2018.

*Primary Examiner* — Joseph H Feild
*Assistant Examiner* — Sharmin Akhter
(74) *Attorney, Agent, or Firm* — von Briesen & Roper, s.c.

(57) ABSTRACT

A monitoring method to detect a state of a door provided with a locking system. The method comprises the following steps: a measurement step during which a mechanical wave sensor measures a signal corresponding to a mechanical wave propagated in the door; a step of comparison between a reference signal stored in the memory and the mechanical wave signal in order to detect a state of the door. The reference signal is measured by the mechanical wave sensor while the locking system of the door is actuated.

12 Claims, 4 Drawing Sheets

(56) References Cited

U.S. PATENT DOCUMENTS

2016/0212598 A1* 7/2016 Wang ..... H04W 4/12

* cited by examiner

METHOD AND DEVICE FOR DOOR MONITORING AND DOOR MONITORING SYSTEM INCLUDING SUCH A DEVICE

CROSS-REFERENCE TO RELATED APPLICATIONS

This application claims priority under the Paris Convention to French Patent Application No. 17/56683 filed on Jul. 13, 2017.

FIELD OF THE DISCLOSURE

The invention relates to the field of devices for monitoring a state of a door and methods implementing such devices.

BACKGROUND OF THE DISCLOSURE

There are currently devices with which to detect a state of a door. State of a door includes a state of locking, unlocking or even opening and closing of the door. Generally, this detection is done by means of one or more sensors included in the device. The device can then send a notification with the state of the door to a user through an interface.

In particular the document US 2011/016971 is known which describes a device integrated in a door or inside a door. The device is able to detect a state of the door, but can also directly influence the state of the door by actuating its bolt.

However, the use of the device described in this document is specific to the type of door described in US 2011/016971. Thus, a user cannot use this device on their door without carrying out work.

SUMMARY OF THE DISCLOSURE

According to a first aspect, the object of the invention is a monitoring method able to detect at least one state of a door provided with a locking system, where this method comprises at least the following steps:

at least one measurement step during which a mechanical wave sensor measures a mechanical wave signal corresponding to a mechanical wave propagated in the door;

at least one step of comparison between a reference signal stored in the memory and the mechanical wave signal in order to detect a state of the door;

Characterized in that it additionally comprises at least one learning step during which said mechanical wave sensor measures the reference signal while the locking system of said door is actuated in a predetermined way.

Because of these arrangements, the monitoring device is able to detect the state of any type of door.

According to an aspect of the invention, the method also comprises a communication step during which data about said state of the door is delivered to a communication device.

The invention also targets a monitoring device able to detect at least one state of a door provided with a locking system, where this device comprises:

At least one mechanical wave sensor, able to measure a mechanical wave signal corresponding to a mechanical wave propagated in the door;

A memory, able to store a reference signal corresponding to a mechanical wave propagated in the door during an actuation of the locking system;

A central unit, able to carry out a comparison between the reference signal stored in the memory and the mechanical wave signal in order to detect a state of the door;

characterized in that the central unit is able to measure the reference signal from the mechanical wave sensor during a learning operation where the locking system of said door is actuated in a predetermined way.

In various embodiments of the monitoring device according to the invention, one and/or another of the following provisions could also be used:

The monitoring device comprises a communication interface, where said central unit is suited for delivering data about said state of the door via the communication interface;

The central unit is able to either be in an active state where it can detect the state of the door, or in a sleep state in which the central unit does not detect the state of the door;

The central unit is able to switch into a sleep state at the end of a preset time without receiving a mechanical wave signal;

The central unit comprises a wake-up input suited for receiving a wake-up signal and said central unit is adapted for switching into an active state when said wake-up signal is received by said wake-up input;

The monitoring device comprises a presence detector connected to said wake-up input for sending said wake-up signal when a presence is detected;

The presence detector is chosen among an infrared detector and a microphone;

The monitoring device comprises a battery which provides the monitoring device an operating time of several months;

The communication interface is a short-range radio interface;

The short-range radio communication interface is suited for operating with a radio communication protocol chosen from: Sigfox®, LoRa®, Bluetooth®, Wi-Fi and ZigBee®.

The invention also targets a system comprising at least one monitoring device according to the invention and at least one communication device able to communicate with the communication interface.

In various embodiments of the system according to the invention, one and/or another of the following provisions could also be used:

The communication device communicates with the Internet;

The system comprises a server suited for remotely communicating with the communication device and able to store the reference signal;

The system also comprises at least one mobile communication unit adapted for remotely communicating with the communication device, and said central unit is suited for delivering said data about the state of the door to the mobile communication unit via the communication interface.

BRIEF DESCRIPTION OF THE DRAWINGS

Other features and advantages of the invention will become apparent during the following description of one of the embodiments thereof, given as a nonlimiting example, with reference to the attached drawings.

In the drawings.

DETAILED DESCRIPTION OF THE DISCLOSURE

Figure 1:
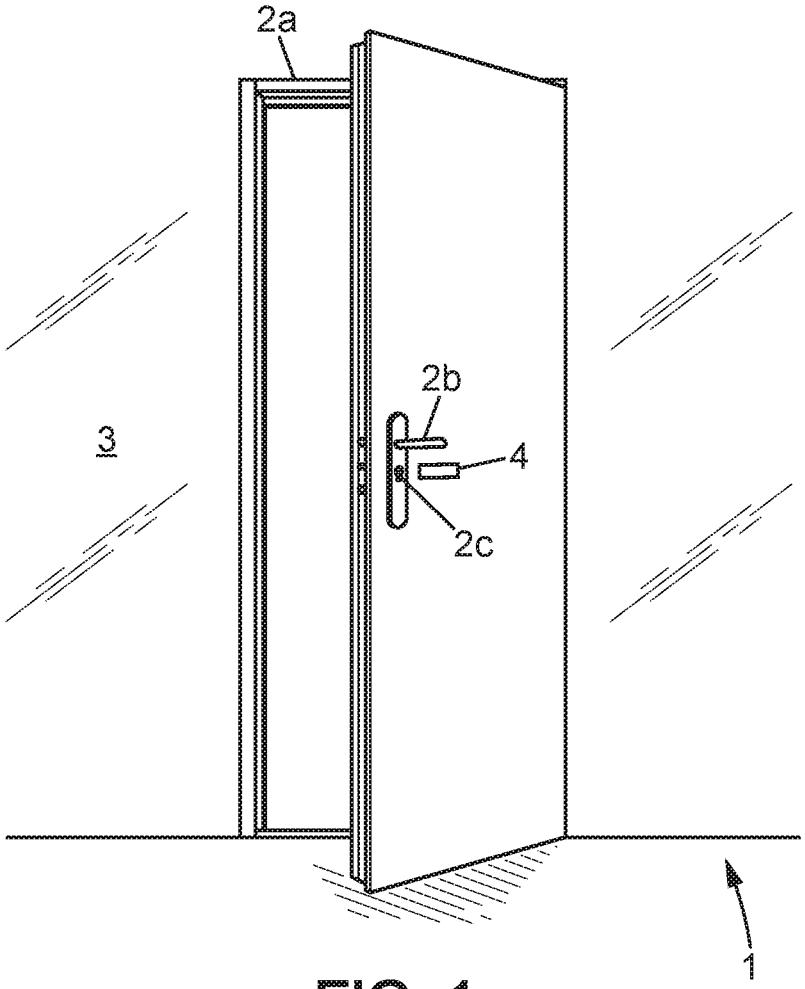
FIG. 1 shows a door equipped with a monitoring device according to an embodiment of the invention.

FIG. 1 shows a building 1 comprising a door 2 and at least one structural element 3, for example a wall. FIG. 1 can be a residence, for example a house or an apartment. It can also be a warehouse, building or even simply a room, for example a bedroom or an office.

The door 2 comprises for example a doorframe 2*a*, a handle 2*b* and a locking system 2*c*, for example a lock or a latch. The door 2 can be made of any kind of material. The door 2 can also be any shape, and in particular can be "swinging door" or "sliding door" type.

The building 1 is equipped with a monitoring device 4 for a state of the door 2. The monitoring device 4 is for example placed on the door 2. It can also be placed on a structural element 3 of the building 1 for example next to the door 2.

To securely join the monitoring device 4 to the building 1, a securing element 5 can be provided, for example a strip of adhesive, with which to directly adhere the monitoring device 4 onto the building 1. As a variant, the monitoring device 4 can be securely connected to a plate, not shown, that comprises a securing element with which the monitoring device 4 can be attached to the door 2.

The monitoring device 4 can have the shape of a small size disk such that the general aesthetics of the building 1 are maintained.

Figure 2:
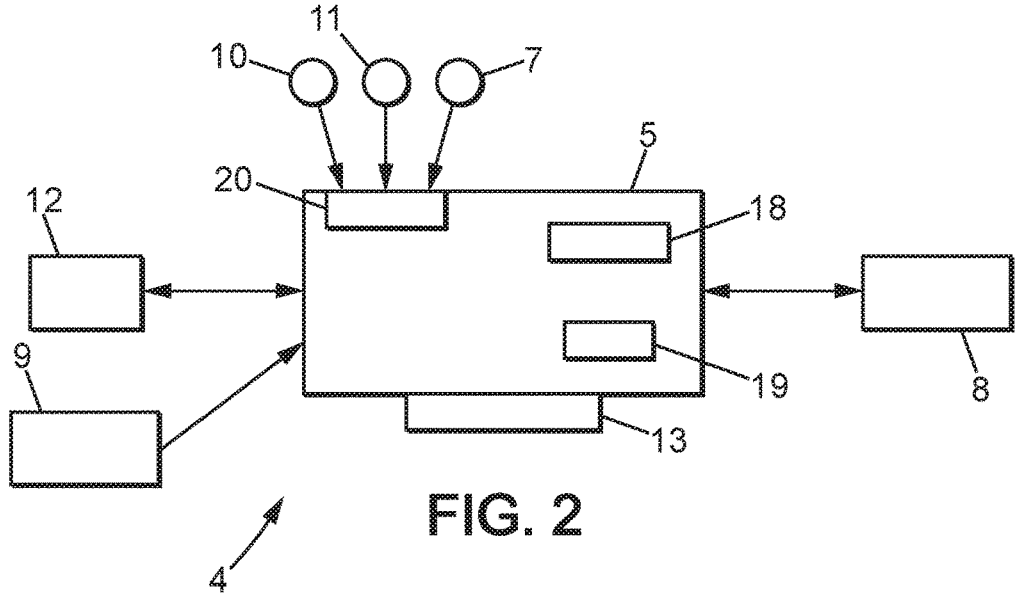
FIG. 2 is a schematic view of the monitoring device with which the door from FIG. 1 is equipped.

As shown in FIG. 2, the monitoring device 4 can comprise a central unit 6, or "controller 6" in the remainder of the description. The controller 6 is, for example, a microcontroller or a microprocessor. The controller 6 can perform various functions for detection of the state of the door 2.

"State of the door" is understood to be, for example, a state of locking, unlocking, opening and closing of the door 2.

The monitoring device 4 also comprises a mechanical wave sensor 7, for example an accelerometer, in communication with the controller 6. The mechanical wave sensor 7 is able to measure a mechanical wave signal propagating in the door 2 or the structural element 3. The mechanical wave signal is for example a vibrational wave signal or a sound wave signal.

The mechanical wave sensor 7 measures in particular the mechanical signals emitted by the locking system 2*c* in order to detect a state of locking and unlocking of the door 2. The mechanical wave sensor 7 can also detect an opening or closing of the door 2, for example, by measuring a mechanical wave signal emitted by the hinges of the door 2 or the door 2 rubbing on the ground. In the case where the mechanical wave sensor 7 is an accelerometer, an opening or closing of the door 2 can in particular be measured by measurement of the acceleration of the door 2 when someone opens or closes it.

The mechanical wave signals thus measured by the mechanical wave sensor 7 are sent to the controller 6 which for example has an analysis module 18. The analysis module 18 has for example at least one converter and a filter in order to make the signal readable.

The monitoring device 4 also comprises a memory 8 able to store a mechanical wave signal referred to as "reference mechanical wave signal."

This reference signal may comprise the mechanical wave signature of the door 2 when the locking system 2*c* is actuated. The memory 8 can therefore store a mechanical wave reference signal corresponding to an unlocking of the door, and a mechanical wave reference signal corresponding to a locking of the door 2.

The signature signals stored in the memory 8 can be sent to a server 6. The signals are for example sent wirelessly over a Bluetooth or Wi-Fi type network. The server for example has a database in which are stored all the reference signals recorded for each door 2 equipped with a monitoring device 4.

In the remainder of the description, the mechanical wave signal may be designated by the term "the signal," and likewise the mechanical wave reference signal may be designated by the term "reference signal."

The reference signal is for example measured by the mechanical wave sensor 7 during a learning step of the monitoring device 4.

The memory 8 and the controller 6 can be in communication, such that when the controller 6 receives a mechanical wave signal measured by the mechanical wave sensor 7, a comparison module 19 included in the controller 6 compares the reference signal stored in the memory 8 with the signal sent by the mechanical wave sensor 7.

Depending on the result of the comparison between the reference signal and the signal measured by the mechanical wave sensor 7, the controller 6 is able to detect the state of the door. More precisely, if the mechanical wave sensor 7 measures a signal that does not correspond to the reference signal from locking the door 2, the controller is able to detect that the door is not locked. Likewise, if the signal measured by the mechanical wave sensor 7 does not correspond to the reference signal from unlocking the door 2, the controller 6 is able to detect that the door 2 is not unlocked.

The monitoring device 4 can also include a battery 9. The battery 9 is, for example, rechargeable. In this case, the monitoring device 4 is provided with a port for recharging the battery 9. The monitoring device 4 can be recharged without separating it from the building 1. As a variant, the monitoring device 4 can be separated while recharging it and later repositioned on the building 1. The battery 9 and the electronic components of the monitoring device 4 are chosen such that the operating time of the battery is at least equal to six months.

As a variant, in order to increase the operating time of the monitoring device 4, it can be planned that the controller 6 can go into a sleep state, in which the monitoring device 4 is unable to detect the state of the door 2, and into an active state, in which the monitoring device 4 is able to detect the state of the door 2.

The controller 6 can control the activation of the monitoring device 4, for example, by means of a presence detector.

The presence detector is for example an infrared sensor 10. The infrared sensor 10 can detect the approach of an object or person. When the infrared sensor 10 sends a signal to the wake-up input 20 of the controller 6 indicating the presence of a person or object, the controller 6 goes into an active state so that the mechanical wave sensor 7 can measure a mechanical wave signal.

As a variant, the monitoring device 4 can be provided with a microphone 11 able to send a signal to the wake-up input 20 indicating the recording of a sound signal at the controller 6. In the same way, when the controller 6 receives such a sound signal, it goes into an active state.

The monitoring device 4 can also include a clock 12. The clock 12 is for example calibrated such that, if no signal is measured by either the infrared sensor 10 or the microphone for a preset time, the controller 6 goes from an active state into a sleep state.

The monitoring device 4 can also include a communication interface 13. The communication interface 13 is for example a short-range radio interface type of Bluetooth, Wi-Fi, Sigfox, LoRa or even Zigbee type. The controller 6 is able to deliver information about the state of the door 2 by means of this communication interface 13.

Figure 3:
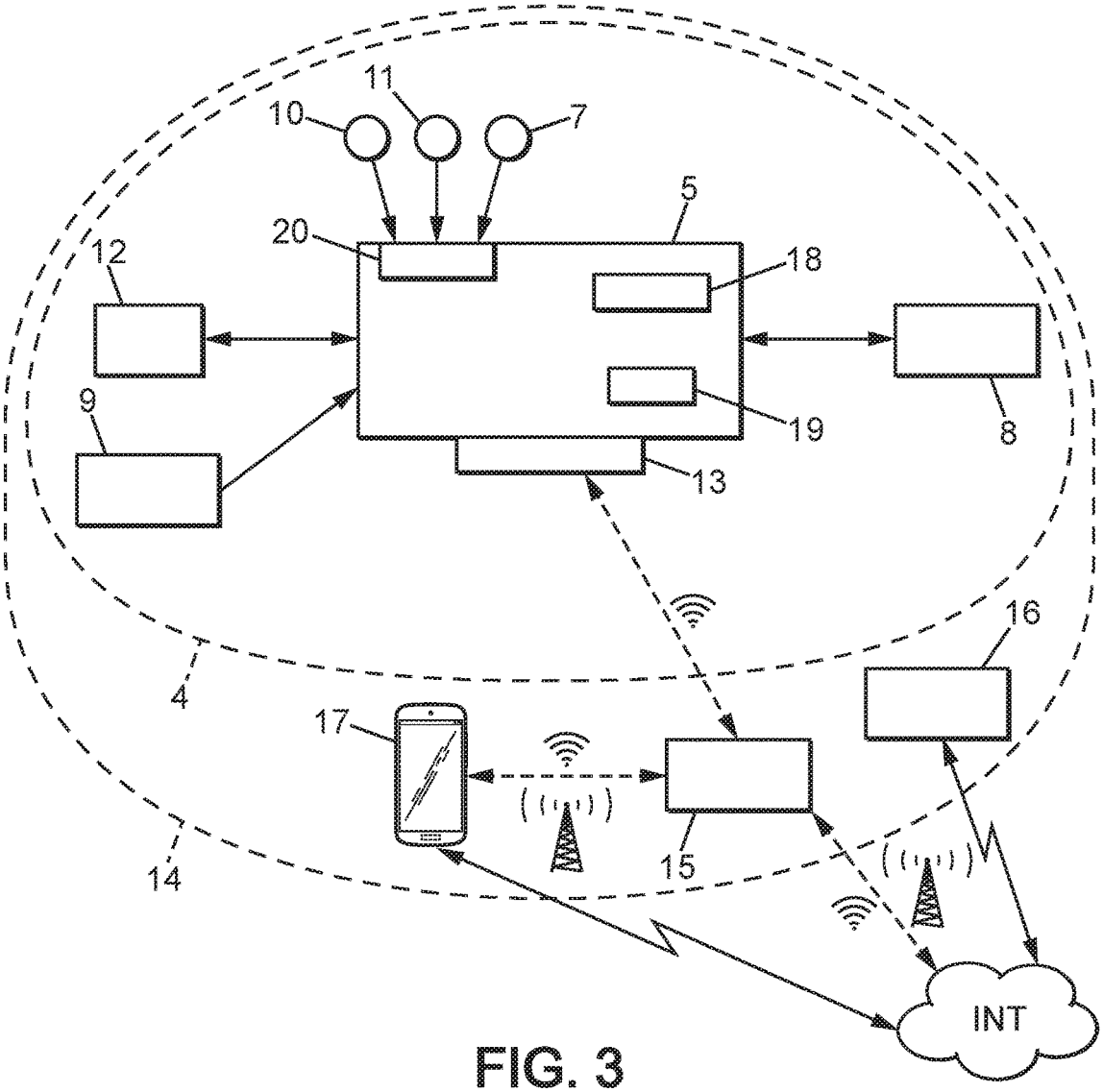
FIG. 3 is a schematic view of a system comprising the monitoring device from FIG. 2.

In connection with FIG. 3, a system 14 in the meaning of the invention is now going to be described.

The system 14 comprises a monitoring device 4 such as described above. It comprises a communication device 15 able to communicate with the Internet. The communication device 15 is chosen for being able to communicate with the communication interface 13.

The communication interface 13 for example sends data about the state of the door 2 to the communication device 15 which then sends these data with a data transfer protocol, for example to a server 16. The server 16 can for example store the reference signal measured by each device in order to form a database gathering a plurality of reference signals corresponding to various types of doors 2.

The system 13 can also comprise a mobile communication unit 17 communicating with the communication device 15. The communication device 15 is able to communicate the data about the state of the door 2 with the mobile communication unit.

For example, the mobile communication unit 17 comprises a mobile application through which the user can retrieve the data about the state of the door.

The mobile communication unit 17 can also be in communication with the communication interface 13. The mobile communication unit 17 receives for example data from a single monitoring device 4. As a variant, it can be provided that the mobile communication unit 17 can receive data from several monitoring devices 4.

The mobile communication unit 17 is for example in communication with the communication interface 13 and/or the communication device 15 during the step of calibration of the monitoring device 4.

Figure 4:
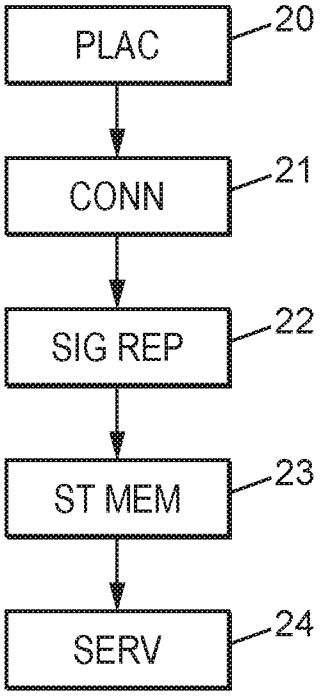
FIG. 4 shows the principal steps of the calibration method for the monitoring device from FIG. 2.
Figure 5:
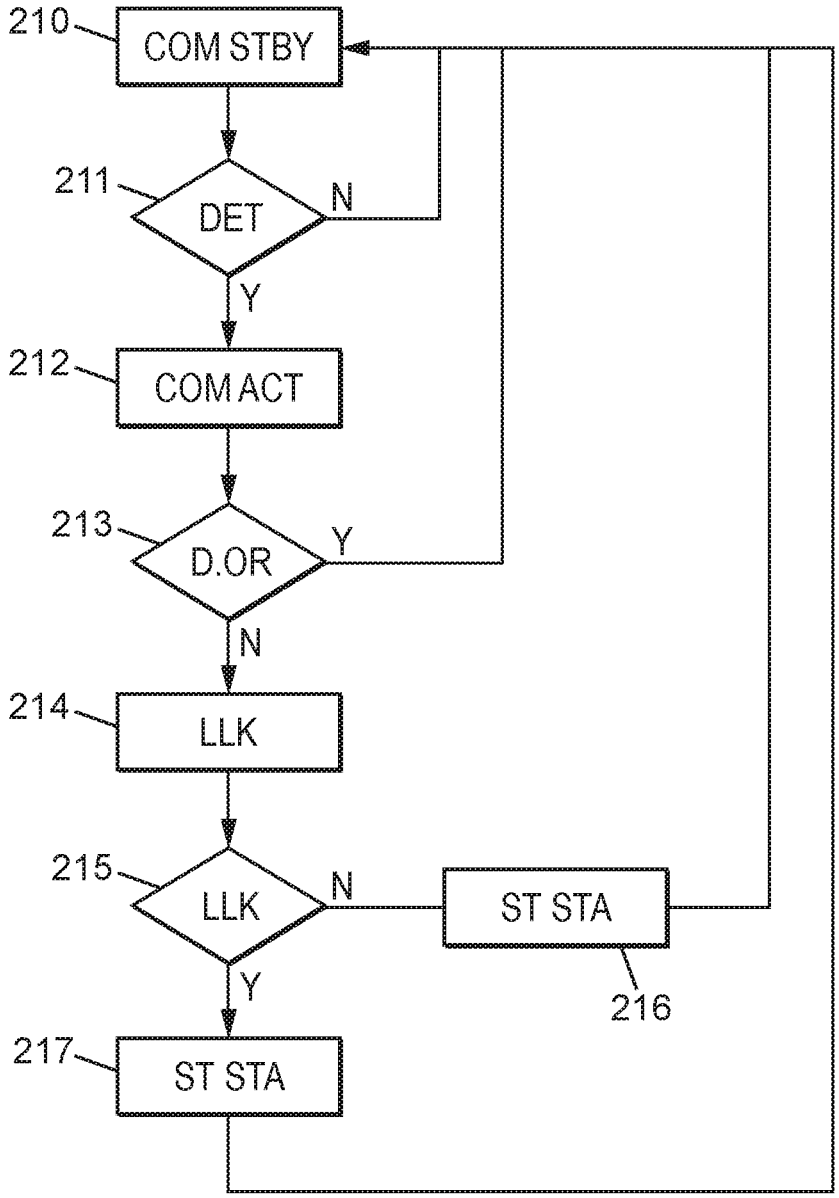
FIG. 5 shows the main steps from the method for detection of a state of the door by the monitoring device from FIG. 2.

Referring to FIGS. 4 and 5, a method making use of the system 13 comprising a monitoring device 4 as described above is explained in more detail.

More precisely, FIG. 4 shows the method for calibration of the monitoring device 4 by the user. With the calibration of the monitoring device 4, the communication interface 13 of the monitoring device 4 is connected to the communication device 15, among other things. Communication between the communication interface 13 and the mobile communication unit 17 can also be established with the calibration.

Still during the calibration phase, the user for example proceeds with a learning step. During the learning step, the device proceeds with the measurement of the reference signal in order to store it in memory 8.

More precisely, the learning step can include the measurement of two reference signals.

In particular, the user actuates the locking system 2*c* of the door 2, such that the door 2 goes from an unlocking state to a locking state. The locking system 2*c* propagates a mechanical wave signal which corresponds to the locking signal. The locking signal is stored in memory as a first reference signal.

The user can also actuate the locking system 2*c* of the door 2, such that the door goes from a locking state to an unlocking state. The locking system 2*c* propagates a mechanical wave signal which corresponds to the unlocking signal. The unlocking signal is stored in memory as a second reference signal.

The reference signals can be stored on the server 16.

In step 20, the user places the monitoring device 4 on the building 1, for example on the structural element 3 or the door 2. Establishing communication of the communication interface 13 both with the communication device 15 and also with the mobile communication unit 17 proceeds in step 21. During this step, the user-related data can also be collected, for example the user's first name, last name, type of door 2, etc. In step 22, the user records the reference signals for the door 2, as described with reference to FIG. 4. The user therefore locks the door and then unlocks the door 2, for example. It is understood that the user could do this in a different order, or they could even record other reference signals, for example a reference signal for opening the door 2.

In step 23, the measured reference signals are stored in the memory 8. Finally, in step 24, the reference signals are sent to the server 16.

FIG. 5 shows the main steps of the method for detection of a state of the door 2 by the monitoring device 4, more specifically a locking or unlocking of the door 2.

At step 210, the controller 6 is in a sleep state in which the monitoring device 4 is unable to measure the state of the door 2. At step 211, it is determined whether a signal is detected by the presence detector comprising an infrared sensor 10 and a microphone 11. If that is not the case, the microcontroller remains in a sleep state. If a signal is measured by the presence detector, the controller 6 changes to active state in step 212, in which the monitoring device 4 is able to detect the state of the door.

The infrared sensor 10 is calibrated such that it only detects a presence if the person or object is very near the door, for example if a person is getting ready to open the door 2. Similarly, the microphone 11 is calibrated such that it only measures a sound signal if the sound source is very close. For example, it is unable to detect the sounds coming from the street, or neighboring rooms (e.g. houses, apartments, etc.). The monitoring device 4 can comprise only one or the other, or one and the other of the infrared sensor 10 or microphone 11.

At step 213, the monitoring device 4 determines whether the door 2 is in open position. For that, the accelerometer type mechanical wave sensor 7 can be used. If the door 2 is open, the controller 6 goes into a sleep state. If the door is closed, the controller 6 sends an activation command for the clock 12 at step 214.

When the controller is in an active state, the mechanical wave sensor 7 measures each mechanical wave signal propagating in the door. When a mechanical wave signal is measured by the mechanical wave sensor 7, as shown at step 215, the controller 6 determines whether the measured mechanical wave signal is a reference signal.

The controller 6 is in an active state for a set time that is measured by the clock 10 at step 215. At the end of this set time, for example a time included between a few seconds and a few minutes, if no reference signal has been detected, the controller 6 goes into a sleep state and stores in the memory 8 the detected state of the door (step 216), here, door locked. If a reference signal is detected, here a reference signal for locking the door 2, the information about the state of the door is stored in step 217.

To access the information about the state of the door, the user queries the mobile communication unit 17. The mobile communication unit 17 is for example "smart phone" type. It has a mobile application with which the user can access data about the state of the door 2.

As a variant, a "computer" type mobile communication unit can be used. Access to the data can then be done by means of an application included on the computer, or else by means of a website.

References:

| | | |
|---|---|---|
| Building | Controller 6 | Communication |
| Door 2 | Mechanical wave | device 15 |
| Frame 2a | sensor 7 | Server 16 |
| Handle 2b | Memory 8 | Mobile |
| Locking system 2c | Battery 9 | communication |
| Structural | Infrared 10 | unit 17 |
| element 3 | Microphone 11 | Analysis module |
| Monitoring device | Clock 12 | 18 |
| 4 | Communication | Comparison module |
| Securing element | interface 13 | 19 |
| 5 | System 14 | Wake-up input 20 |

The invention claimed is:

1. A monitoring method configured to detect at least one state of a door provided with a locking system, the method comprising an initial learning step during which a mechanical wave sensor measures at least a first reference signal corresponding to a mechanical wave signal propagated in the door while the locking system of said door is actuated according to a locking action, and a second reference signal corresponding to a mechanical wave signal propagated in the door while the locking system of said door is actuated according to an unlocking action, where this method comprises at least the following subsequent steps during use of the door:

at least one measurement step during which said mechanical wave sensor measures a mechanical wave signal corresponding to a mechanical wave propagated in the door;

at least one step of comparison during which the first and second reference signals and the mechanical wave signal are compared to determine if the locking system of the door has been locked or unlocked; and according to the result of said comparison, a determination is made if the door is in a locking state or an unlocking state.

2. A monitoring device configured to detect at least one state of a door provided with a locking system, this device comprising:

at least one mechanical wave sensor, configured to measure a mechanical wave signal corresponding to a mechanical wave propagated in the door;

a memory, configured to store at least a first reference signal corresponding to a mechanical wave signal propagated in the door while the locking system of said door is actuated according to a locking action, and a second reference signal corresponding to a mechanical wave signal propagated in the door while the locking system of said door is actuated according to an unlocking action; and a central unit, configured to carry out a comparison between the first and second reference signals stored in the memory and the mechanical wave signal and to determine if the locking system of the door has been locked or unlocked, and according to the result of said comparison, to determine if the door is in a locking state or an unlocking state.

3. The monitoring device according to claim 2, further comprising a communication interface, where said central unit is suited for delivering data about said state of the door via the communication interface.

4. The monitoring device according to claim 2, wherein the central unit is configured to either be in an active state where it can detect the state of the door, or in a sleep state in which the central unit does not detect the state of the door.

5. The monitoring device according to claim 4, wherein the central unit is configured to switch into a sleep state at the end of a preset time without receiving a mechanical wave signal.

6. The monitoring device according to claim 5, wherein the central unit comprises a wake-up input suited for receiving a wake-up signal and said central unit is adapted for switching into an active state when said wake-up signal is received by said wake-up input.

7. The monitoring device according to claim 6, further comprising a presence detector connected to said wake-up input for sending said wake-up signal when a presence is detected.

8. The monitoring device according to claim 3, wherein the communication interface is a short-range radio interface.

9. A system comprising at least one monitoring device according to claim 3 and at least one communication device configured to communicate with the communication interface.

10. The system according to claim 9, further comprising at least one mobile communication unit adapted for remotely communicating with the communication device, and said central unit is suited for delivering said data about the state of the door to the mobile communication unit via the communication interface.

11. The system according to claim 10, further comprising a server suited for remotely communicating with the communication device and configured to store the first and second reference signal.

12. The method according to claim 1 further comprising a communication step during which data about said state of the door is delivered to a communication device.

* * * * *